US005890349A

United States Patent [19]

Heisler et al.

[11] Patent Number: 5,890,349

[45] Date of Patent: Apr. 6, 1999

[54] METHOD AND APPARATUS FOR SEATING LIDS ON CONTINUOUSLY CONVEYED PRE-FORMED CONTAINERS

[76] Inventors: Rick Heisler, 11 Conestoga St., Franklin Lakes, N.J. 07417; Ronald Heisler, 7 Harvin Place, Mahwah, N.J. 07470

[21] Appl. No.: 25,361

[22] Filed: Feb. 18, 1998

[51] Int. Cl.[6] ..... B65B 7/28; B65B 57/02

[52] U.S. Cl. ..... 53/485; 53/329; 53/314; 53/76

[58] Field of Search ..... 53/75, 76, 282, 53/314, 315, 316, 319, 328, 329, 329.4, 485, 489, 330, 367, 471

[56] References Cited

U.S. PATENT DOCUMENTS

| | | | |
|---|---|---|---|
| 1,503,034 | 7/1924 | Dalrymple | 53/329 X |
| 1,920,539 | 8/1933 | White | 53/485 X |
| 3,474,595 | 10/1969 | Moroney et al. | 53/329.4 |
| 4,959,944 | 10/1990 | Heisler | 53/313 |
| 5,050,367 | 9/1991 | Heisler | 53/367 X |
| 5,438,814 | 8/1995 | Lovett et al. | 53/367 X |

*Primary Examiner*—Linda Johnson
*Attorney, Agent, or Firm*—Patrick J. Pinto

[57] ABSTRACT

A method and apparatus for the on-demand seating of a lid on pre-formed containers that are carried on a continually moving conveyor. A lid press plate (20) is connected to a linear actuator (36) by a mounting assembly (17). The mounting assembly (17) transmits a seating force from the linear actuator (36) to the lid press plate (20) for seating the lid while simultaneously allowing the horizontal movement of the lid press plate (20) from a first position to a second position by a driving force resulting solely from the application of a seating pressure between the lid press plate (20) and the lid (46). The lid press plate moves at the same velocity as the pre-formed container during application of the seating pressure. The lid press plate (20) is returned to the first position by a biasing assembly (18), after removal of the seating pressure.

20 Claims, 3 Drawing Sheets

METHOD AND APPARATUS FOR SEATING LIDS ON CONTINUOUSLY CONVEYED PRE-FORMED CONTAINERS

BACKGROUND OF THE INVENTION

1. Field of the Invention

With regard to the classification of art, this invention is believed to be found in the general class entitled Package Making and more particularly to those subclasses pertaining to the seating of a lid on a pre-formed container by means of a lid press.

2. Description of Related Art

Pre-formed containers such as molded pails, buckets and the like are used in the distribution of various products. These containers require a lid to be seated or secured thereto after a filling operation, in a processing plant.

Usually the lids are placed on the pre-formed container by a lid placing apparatus similar to U.S. Pat. No. 4,959,944, that issued to Heisler on Oct. 2, 1990, or U.S. Pat. No. 5,050,367, that issued to Heisler on Sep. 24, 1991. These patents, cited above, are illustrative of apparatus and methods for placing a lid on a pre-formed container. Each of the cited patents employ a roller compression system for seating the lids after placement. It has been found that the roller compression system may not meet the industry requirements for applying certain lids onto containers containing products that may need to be burped to reduce trapped air.

U.S. Pat. No. 5,438,814, that issued to Lovett et al on Aug. 8, 1995, attempted to address the seating of a lid on a continuously conveyed pre-formed container. However it has been found that the solution that was proposed by Lovett in U.S. Pat. No. 5,438,814 may not provide reliable results under actual manufacturing conditions. In order for the Lovett apparatus to function properly, the horizontal movement of the lid press plate must exactly match the velocity of the continually moving conveyor carrying the pre-formed container. However, it has been found that tipping of the container may occur when there is any variation between the velocity of the lid press plate and the container using the Lovett apparatus. Any tipping or jostling of the filled container prior to the full seating of the lid results in spillage of the product onto the outside of the container or onto the floor of the production area. One of the problems anticipated with the Lovett apparatus is in the timing of and/or controlling the constant velocity of the transfer cylinder that provides the horizontal movement of the lid press plate. In the Lovett apparatus the transfer cylinder must move a relatively heavy mass. That heavy mass includes at least: the carriage and the pneumatic press cylinder that are attached to the lid press plate. The transfer cylinder and its pneumatic controls are responsive to the pneumatic force in the compressed air pressure that is supplied in the manufacturing environment. Any pressure drop in the compressed air supply or pneumatic control system will effect the constant speed and response of the transfer cylinder by slowing its horizontal velocity. Any variation of the back pressure in the exhaust air control lines will also effect the velocity of the transfer cylinder. Another problem anticipated with the Lovett apparatus is in the matching of the container speed when the velocity of the conveyor may vary due to voltage fluctuations and or frictional loading at any particular time. The Lovett apparatus may require the constant attention and adjustment by an operator. Any constant attention that is required would add to the operating cost of producing the end product. Any spillage would result in product loss and resultant clean up costs and containment that would also add to operating costs.

The present invention addresses the problems identified above by exactly matching the velocity of the lid press plate to the velocity of the container at any time by allowing the container to apply a driving force to the lid press plate. Variations in conveyor speed and/or normal variations in the compressed air pressure have little or no effect on its matching of the velocity.

SUMMARY OF THE INVENTION

The present invention may be summarized with respect to its objects. It is an object of this invention to provide and it does provide an on-demand method and apparatus that seats and secures lids on continuously conveyed pre-formed containers.

It is another object of this invention to provide and it does provide a method and apparatus that seats lids on a continually conveyed pre-formed container. This apparatus provides a biased mounting means between a lid press plate and a pressure cylinder for allowing relative horizontal movement therebetween.

It is a further object of this invention to provide and it does provide a method and apparatus for the on-demand seating of a lid on a continually conveyed pre-formed container that seats the lids on successive abutting or separated pre-formed containers.

It is yet another object of this invention to provide and it does provide a method and apparatus that seats lids on continually conveyed pre-formed containers in which the pre-formed container provides a driving force for moving an abutting lid press plate from a first position to a second position then utilizes a biasing means to rapidly return the lid press plate towards the first position when and as the driving force is removed from the lid press plate.

One embodiment of present invention may be briefly described as: a method of fully seating a lid on a pre-formed container including the steps of:

a) sensing the presence of a pre-formed container at a selected first position by means of a first sensor, the selected first position being under a lid press plate and in a selected alignment therewith; the pre-formed container, including its lid previously placed thereon, being transported under the lid press plate in a first horizontal direction by and on a continually moving conveyor;

b) advancing the lid press plate in a first vertical direction by selectively actuating a linear actuator as and when the first sensor senses the pre-formed container and lid;

c) fully seating the lid on a lip portion of the pre-formed container by applying a sealing or seating pressure to the lid by and with the lid press plate while simultaneously allowing movement of the lid press plate in the first horizontal direction at a same velocity as the pre-formed container and lid by means of a driving force resulting solely from the applying of the seating pressure to the lid, the lid press plate being attached to the linear actuator by a mounting means for allowing relative horizontal movement thereof with respect to a vertical axis of the linear actuator;

d) sensing the displacement of the lid press plate and the pre-formed container being transported in the first horizontal direction from the first position to a second position by and with a second sensor, the second sensor being selectively arrayed at the second position;

e) retracting the lid press in a second vertical direction that is opposite to the first vertical direction by selectively actuating the linear actuating means in response to a signal from the second sensor; and f) returning the lid press plate towards the first position solely by a selective force of a biasing means only after the lid press plate is retracted sufficiently to relieve the driving force between the lid press plate and the lid.

In addition to the above summary, the following disclosure is intended to be detailed to insure adequacy and aid in the understanding of the invention. However, this disclosure, showing particular embodiments of the invention, is not intended to describe each new inventive concept that may arise. These specific embodiments have been chosen to show at least one preferred or best mode of the present invention. These specific embodiments, as shown in the accompanying drawings, may also include diagrammatic symbols for the purpose of illustration and understanding.

Figure 1:
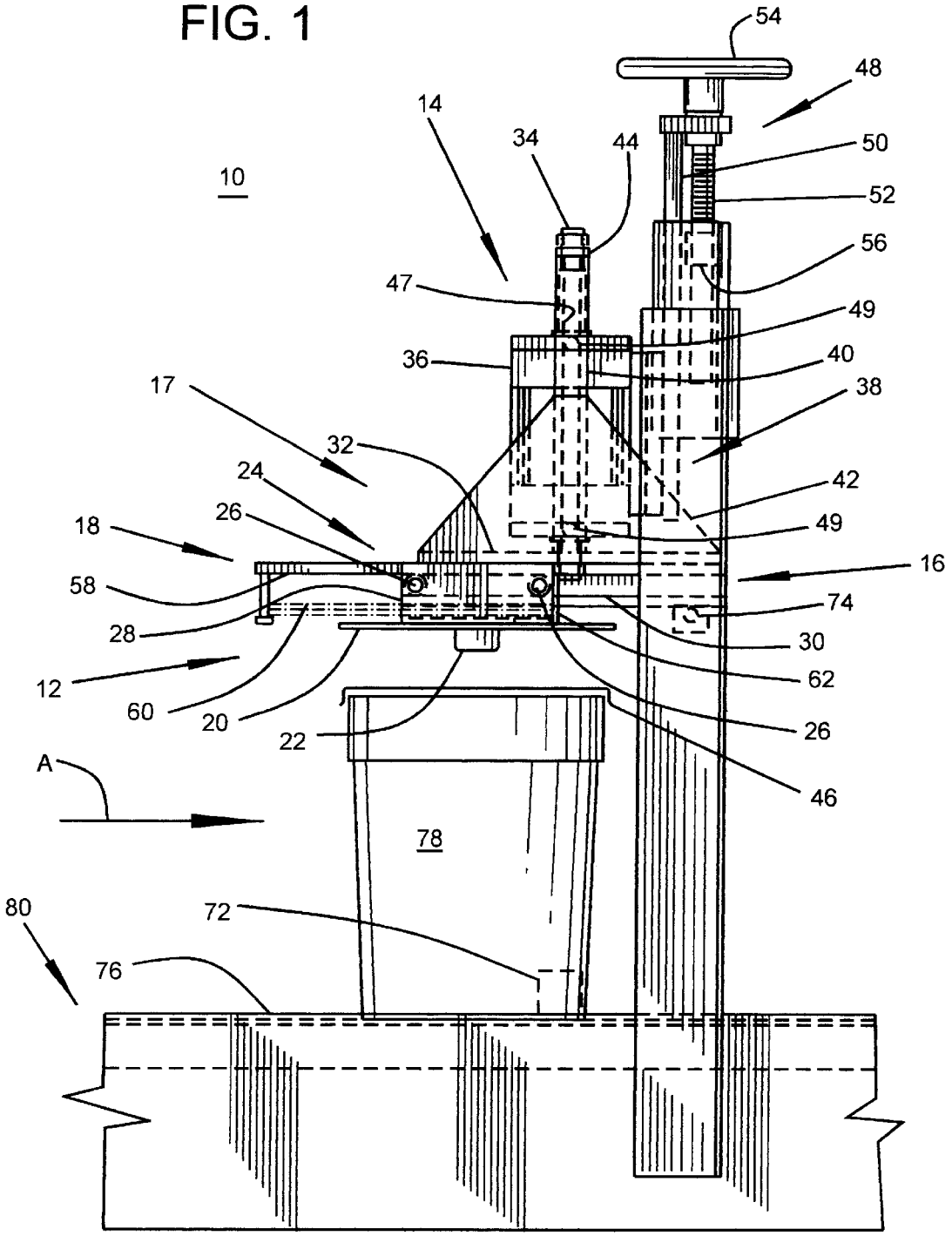
FIG. 1 represents a front elevation of a lid seating apparatus of the present invention.

In the following description and in the appended claims, various details are identified by specific names for convenience. These names are intended to be generic in their application while differentiating between the various details. The corresponding reference numbers refer to like members throughout the several figures of the drawing.

The drawings accompanying and forming a part of this specification disclose details of construction for the sole purpose of explanation. It is to be understood that structural details may be modified without departing from the concept and principles of the invention as claimed. This invention may be incorporated into other structural forms than shown.

DETAILED DESCRIPTION OF THE INVENTION

Figure 2:
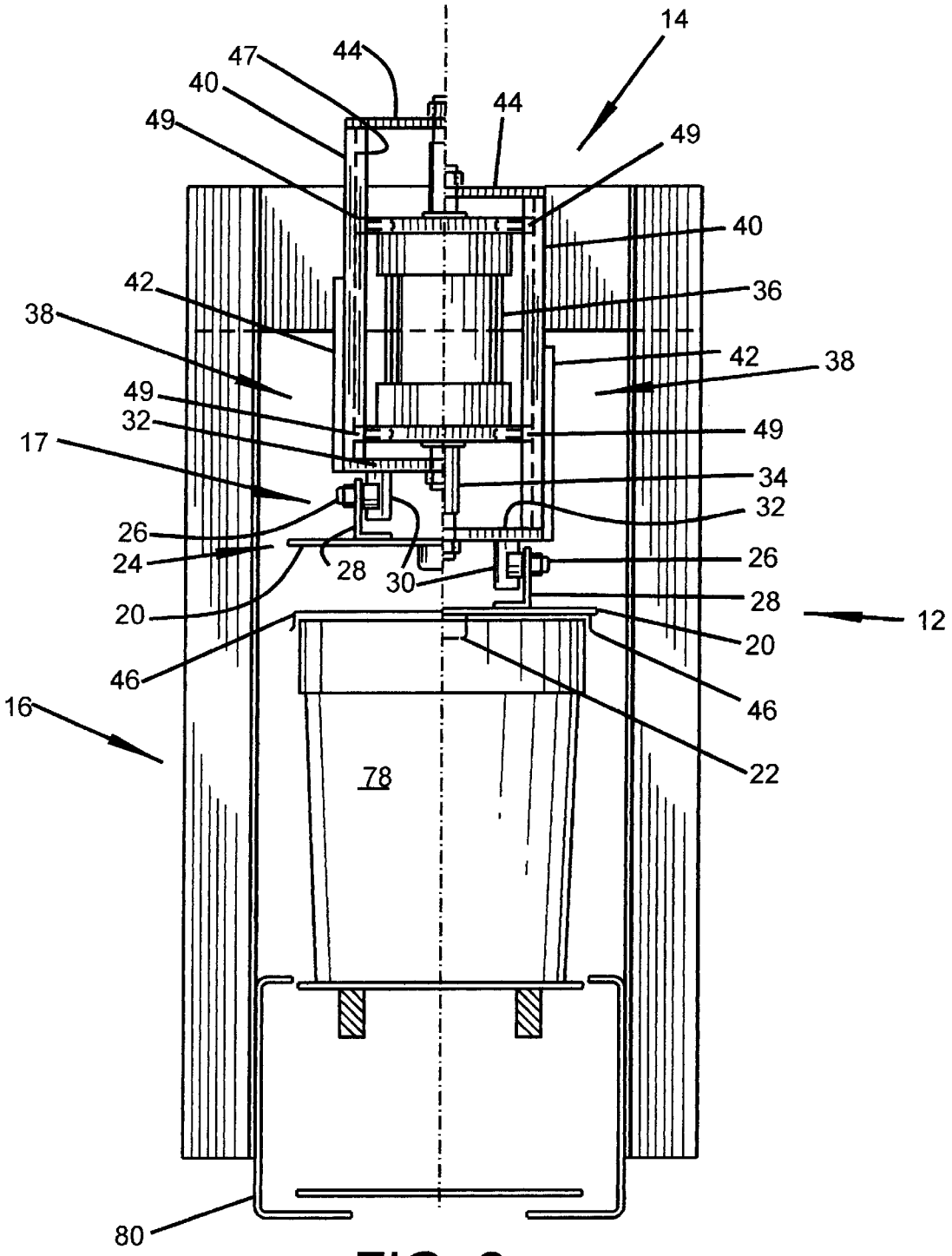
FIG. 2 represents a left side elevation of the present invention, this view being partly in section and being split along the vertical center line of the apparatus. The left side of the view showing the lid press plate in a raised condition, the right side of the view showing the lid press plate at or near the seating position.
Figure 3:
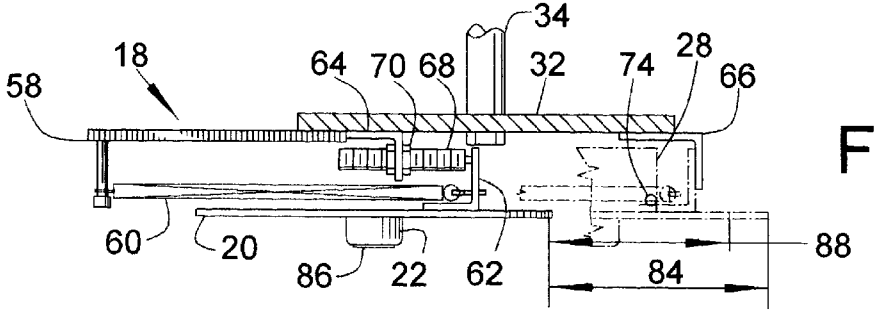
FIG. 3 represents a fragmentary sectional view of a the lid press plate and its associated biasing means.

Referring first to FIGS. 1 through 3, a lid seating apparatus of the present invention is generally identified as 10. One embodiment of this lid seating apparatus 10 includes a lid press assembly 12, a linear actuator assembly 14, and a frame assembly 16. The lid seating apparatus 10 is depicted as being arrayed for removably attaching to a conveyor assembly by commercially available fastening means such as bolts, nuts and the like. However the frame assembly 16 may be of a free standing type having its own base.

The lid press assembly 12 is preferably attached to the linear actuator assembly 14 by a mounting means 17 for allowing a predetermined degree of horizontal relative movement therebetween. The first position of the lid press assembly 12, for the purpose of this discussion, is to the left of the vertical axis of the linear actuator assembly 14. The lid press assembly is urged towards that first position by a biasing means 18. One embodiment of a lid press assembly 12 includes a lid press plate 20, and a burping button 22.

The mounting means 17 includes: a guide bearing support 24, a plurality of guide bearings 26; a pair of guide bearing tracks 30; and a base plate 32. The guide bearing support 24 is depicted as a pair of opposed angle brackets 28, more clearly seen in FIG. 2, that are attached or secured to the lid press plate 20, but not limited thereto. However in some applications, the opposed angle brackets 28 may be replaced with a single channel member. It is also anticipated however, that the lid press plate and the guide bearing support may be combined and fabricated as a single integral unit. It has been found that the high loading capacity and relatively small size of a standard cam follower bearing provide an excellent choice for the guide bearings 26, but not limited thereto. The guide bearings 26 cooperate with the pair of guide bearing tracks 30. Each of the guide bearing tracks 30 is formed as an elongated U-shaped bar or cam track. Each of the tracks 30 is arrayed to guide the guide bearings 26, associated therewith, for allowing the relative movement between lid press assembly 12 and the linear actuator assembly 14. Each of the guide bearing tracks 30 is fastened to a base plate 32 by a plurality of threaded fasteners.

The base plate 32 is attached to an attaching end of the piston rod 34 of a linear actuator 36. It is preferred that a guide means 38 be attached or fastened to the base plate 32 by a suitable means such as threaded fasteners. The guide means 38 is preferably arrayed for providing additional support and guidance as the base plate 32 moves in a vertical direction during the seating of the lid 46. The guide means 38 includes a pair of vertical guide tracks 40, a pair of gusset plates 42, and a tie bar 44. It is preferred that the linear actuator 36 be of a double rod end type for attaching the guide means 38 to both ends of the piston rod 34. This preferred arrangement of the guide means 38 minimizes the deflection of the base plate 32 due to the eccentric forces developed during the seating of the lid 46 on the pre-formed container at any point between the first position or a second position. The second position, for the purpose of this discussion, is to the right of the axis of the linear actuator 36. The vertical guide tracks 40 have grooves 47 formed therein. These grooves 47 are shaped and sized for close guidance by a plurality of guiding members 49. The guiding members 49 are arrayed in pairs in a spaced relationship on opposing sides of the linear actuators 36 cylinder heads. One non limiting example of a guiding member 49 is a commercially available cam follower. The cam follower is preferred for the same reasons cited above in connection with guide bearings 26.

The linear actuator 36 may be mounted directly to the frame assembly 16, as depicted in FIG. 2. Alternatively and preferably the linear actuator 36 is attached to the frame assembly 16 by way of a vertical adjusting means 48, as seen in FIG. 1. The vertical adjusting means 48 is arrayed for allowing easy vertical adjustment of the lid press plate 20 with respect to a top edge of the pre-formed container. One embodiment for a vertical adjusting means 48 is depicted as a sliding gib 50 that is attached to the linear actuator 36. The sliding gib 48 is movable and guided with respect to the frame assembly 16. The movement is controlled by a threaded rod 52 and handle 54 arrangement. A threaded block 56 is fastened to the frame assembly 16 so that rotation of the handle 54 will result in the movement of the lid press plate 20 in a vertical direction to a selected vertical position with respect to the container. The vertical adjusting means 48 may also include a locking means, not shown, for securing and maintaining the selected vertical relationship between the lid press plate 20 and the pre-formed container.

As mentioned above, the biasing means 18 is arrayed for urging the lid press assembly 12 towards the first position on the left side of the linear actuator assembly 14. One embodiment of the biasing means 18 and its related components is depicted in FIGS. 1 through 3. This preferred, but non limiting, embodiment of a biasing means 18 further includes; a post assembly 58, an extension spring 60, a first stop bracket 62, a second stop bracket 64 and a third stop bracket 66, all of which may be more clearly seen in FIG. 3. It is preferred that a dashpot, shock absorber or cushion 68 be arrayed between the first stop 62 and the second stop 64 for controlling deceleration of the lid press assembly 12 with respect to the linear actuator assembly 14 for minimizing impact forces and noise. Preferably, the first stop bracket 62 also acts as an anchor point for one end of the extension spring 60 while the post assembly 58, cantilevered from base plate 32, provides an anchor for the opposite or distal end of the spring 60. The second stop bracket 64 is fastened to the base plate 32.

The cushion 68 is adjustably mounted in and on the second stop bracket 64 by way of a threaded connection and jam nuts 70. This adjustable mounting allows for selective manual adjustment of the first position of the lid press assembly 12.

Use and Operation

Referring now to FIGS. 3 through 6, the operation of the lid seating apparatus 10 is controlled by a first sensor 72 and a second sensor 74. The first sensor 72, may be mounted on the conveyor frame 76 for sensing the presence of a pre-formed container 78 thereon. Some examples of a first sensor 72 include a light beam or infrared sensor, a limit switch, and the like. The second sensor 74 is preferably mounted to the guide bearing track 30 at a position that senses the position of the guide bearing support 24 at the second position. One example of a second sensor 74 is a proximity switch, but not limited thereto.

Figure 4:
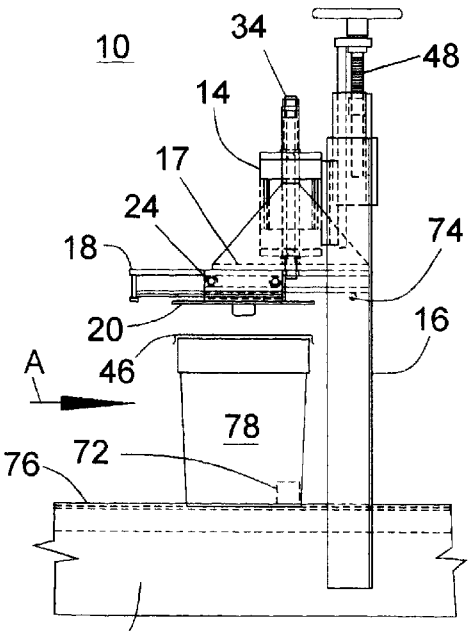
FIG. 4 represents a front elevation of the present invention in a reduced scale. This view showing a first step in a lid seating process.

Referring in particular to FIG. 4, a pre-formed container 78 is continually transported on a conveyor assembly 80, such as a plate conveyor, in the direction of arrow "A". The conveyor assembly 80 must be adapted for withstanding the seating forces applied by the lid seating apparatus 10. The pre-formed container 78 is detected by the first sensor 72. Simultaneously, the lid press plate 20 is positioned at the first position near the leftward extent of its travel, more clearly seen in FIG. 3. The position of the first sensor 72 should be adjustable, for timing the beginning of the seating cycle with respect to the position of the container 78. It is to be noted that the height of lid press plate 20 should also have been previously adjusted to within a predetermined position above the container 78 by means of the vertical adjusting means 48.

Figure 5:
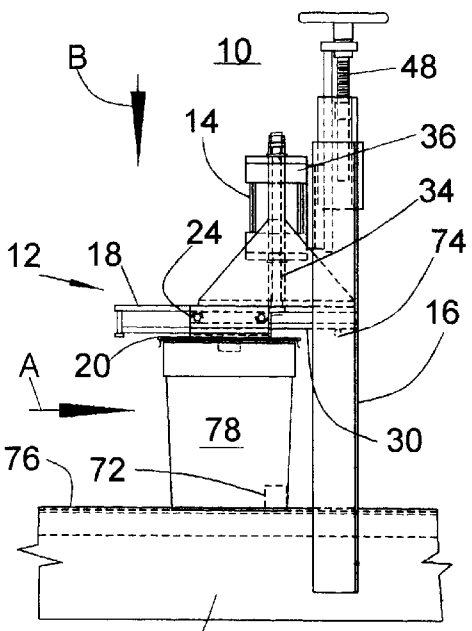
FIG. 5 represents a front elevation of the present invention, in the same scale as FIG. 4. This view showing a second step in the lid seating process in which the lid press plate applies pressure to a lid at a first position.

Referring now to FIG. 5, after the container 78 is detected by the first sensor 72, the piston rod 34 of the linear actuator 36 is urged in the direction of arrow "B" thereby moving the base plate 32 and the lid press plate 20, slidably attached thereto by the mounting means 17, downward for applying a seating pressure or force on the lid 46 and container 78 assembly. The friction between the lid press plate 20 and the lid 46 provides a driving force for urging the lid press assembly 12 to the right in the direction of container travel, depicted as arrow "A". This movement in the rightward direction is relative to the longitudinal axis of the piston rod 34 of the linear actuator 36.

Figure 6:
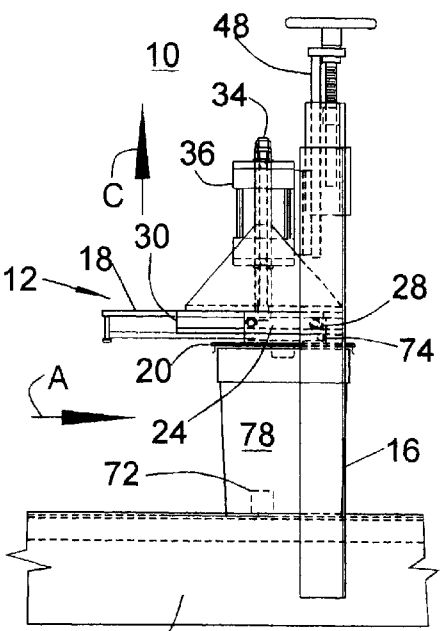
FIG. 6 represents a front elevation of the present invention, in the same scale as FIG. 4 and FIG. 5. This view showing a third step in the lid seating process and particularly showing the lid press plate at a second position just prior to its disengagement from the lid.

Referring now in particular to FIG. 6, the lid press plate 20 of the lid press assembly 12 is depicted as being at a second position and moving towards the extent of its rightward travel. The second sensor 74 detects the leading edge of a leg of the angle bracket 28. The second sensor 74 provides a signal to the linear actuator 36 for retracting the piston rod 34, in the direction of arrow "C", thereby urging the lid press plate 20 away from the lid 46. After disengagement of the lid press plate 20 from the lid 46, the lid press plate 20 is rapidly and immediately returned to and towards the first position by the biasing means 18 for repeating of the lid seating cycle if a container is present, as shown in FIG. 4.

Referring next to FIG. 3, the extent of the horizontal travel 84 of the lid press plate need only be in the neighborhood of 20.3 cm. (8 in.) for a 5 gal container. It is preferred that the center of the horizontal travel 84 be aligned near the axis of the piston rod 34. It has also been found that the apparatus as described above is capable of handling the seating of lids on the container in an on-demand fashion. In this example, it has also been found that the distance 88 between the first position and the second position be in the vicinity of 15.2 cm. (6 in.). A third sensor may be mounted near the third stop 66 to act as an interlock for retracting the lid press plate, stopping the conveyor 80 and sounding an alarm in the event the second sensor has an electrical or mechanical malfunction.

In some instances, it may be necessary to provide a friction face 86 on the burping plug 22. In the event that a burping plug is not used, a friction surface may be provided on a face of the lid press plate 20 that will be in contact with the lid 46. The lid press plate 20 has been depicted as having a substantially uniform cross section. In some application it may be desirable to remove areas of the mass of the lid press plate 20 for reducing its weight. A reduction in weight results in a reduction of the forces required to drive the lid press assembly 12 from the first position towards the second position and its return.

Directional terms such as "front", "back", "in", "out", "down", "up", "lower" "left" "right" and the like may have been used in the description. These terms are applicable to the embodiments shown and described in conjunction with the drawings. These terms are merely used for the purpose of description in connection with the drawings and do not necessarily apply to the position in which the present invention may be used.

While these particular embodiments of the present invention have been shown and described, it is to be understood that the invention is not limited thereto and protection is sought to the broadest extent that the prior art allows.

What is claimed is:

1. A method of fully seating a lid on a pre-formed container including the steps of:

a) sensing the presence of a pre-formed container at a selected position by means of a first sensor, the selected position being under a lid press plate and in a selected alignment therewith; the pre-formed container, including its lid previously placed thereon, being transported under the lid press plate in a first horizontal direction by and on a continually moving conveyor;

b) advancing the lid press plate in a first vertical direction by selectively actuating a linear actuator as and when the first sensor senses the pre-formed container and lid, the lid press plate being attached to a piston rod of the linear actuator by a mounting means;

c) fully seating the lid on a lip portion of the pre-formed container by applying a seating pressure to the lid by and with the lid press plate while simultaneously allowing movement of the lid press plate from a first position, said movement being in the first horizontal direction and at a same velocity as the pre-formed container and lid by means of a driving force resulting solely from the applying of the seating pressure to the lid;

d) sensing the displacement of the lid press plate and the pre-formed container being transported in the first horizontal direction from the first position to a second position by and with a second sensor, the second sensor being selectively arrayed at the second position;

e) retracting the lid press plate at the second position in a second vertical direction that is opposite to the first vertical direction by selectively actuating the linear actuator in response to a signal from the second sensor; and f) returning the lid press plate towards the first position solely by a selective force of a biasing means only after the lid press plate is retracted sufficiently to relieve the driving force between the lid press plate and the lid.

2. A method as recited in claim 1 wherein the mounting means allows horizontal relative motion between the lid press plate and the longitudinal axis of the piston rod.

3. A method as recited in claim 2 wherein the mounting means further includes a guide means for minimizing deflection of a base plate of the mounting means due to eccentric forces.

4. A method as recited in claim 3 wherein said piston rod of the linear actuator is of the double rod end type and the guide means is simultaneously attached to each end of the piston rod.

5. A method as recited in claim 1 which further includes the step of adjusting the vertical position of the lid press plate with respect to the pre-formed container by selectively adjusting a vertical adjusting means.

6. An apparatus for fully seating a lid on a pre-formed container including:

a) a first sensor that is selectively positioned for detecting the presence of a pre-formed container at a selected position, the selected position being under a lid press plate, the pre-formed container including a lid previously placed thereon being transported under the lid press plate in a first horizontal direction on and by a continually moving conveyor;

b) a linear actuator being arrayed for advancing the lid press plate in a first vertical direction upon a receiving a signal resulting from the detection of the pre-formed container by the first sensor, said linear actuator being mounted to a frame assembly by an attachment means that positions the lid press plate over the continually moving conveyor;

c) a mounting means for attaching the lid press plate to a piston rod of the linear actuator, the mounting means being arrayed for transmitting a seating pressure from the linear actuator to the lid press plate, the mounting means allowing horizontal movement of the lid press plate from a first position to a second position and at the same velocity as the pre-formed container, the horizontal movement being by means of a driving force resulting solely from the applying of a seating pressure to the lid;

d) a second sensor that is selectively arrayed at the second position for detecting the movement of the pre-formed container at the second position, the second sensor providing a retract signal to the linear actuator for urging the linear press plate away from the lid in a second vertical direction that is opposite to the first vertical direction; and e) a biasing means that is arrayed for rapidly returning the lid press plate towards and to the first position at the moment the driving force between the lid press plate and the lid is removed.

7. An apparatus as recited in claim 6 wherein the mounting means allows horizontal relative motion between the lid press plate and the longitudinal axis of the piston rod.

8. An apparatus as recited in claim 7 wherein the mounting means further includes a guide means for minimizing deflection of a base plate of the mounting means due to eccentric forces.

9. An apparatus as recited in claim 8 wherein said piston rod of the linear actuator is of the double rod end type and the guide means is simultaneously attached to each end of the piston rod.

10. An apparatus as recited in claim 6 wherein the attachment means includes a vertical adjusting means that is arrayed for selectively adjusting the vertical position of the lid press plate with respect to the pre-formed container.

11. An apparatus as recited in claim 6 wherein the biasing means includes an extension spring, one end of the extension spring being attached to the lid press plate while having its distal end attached to a guide means.

12. An apparatus as recited in claim 7 wherein the biasing means includes an extension spring, one end of the extension spring being attached to the lid press plate while having its distal end attached to the guide means.

13. An apparatus as recited in claim 8 wherein the biasing means includes an extension spring, one end of the extension spring being attached to the lid press plate while having its distal end attached to the guide means.

14. An apparatus as recited in claim 9 wherein the biasing means includes an extension spring, one end of the extension spring being attached to the lid press plate while having its distal end attached to the guide means.

15. An apparatus as recited in claim 10 wherein the biasing means includes an extension spring, one end of the extension spring being attached to the lid press plate while having its distal end attached to the guide means.

16. An apparatus as recited in claim 6 wherein the biasing means further includes a cushion means for controlling deceleration of the lid press plate near the first position.

17. An apparatus as recited in claim 11 wherein the biasing means further includes a cushion means for controlling deceleration of the lid press plate near the first position.

18. An apparatus as recited in claim 12 wherein the biasing means further includes a cushion means for controlling deceleration of the lid press plate near the first position.

19. An apparatus as recited in claim 13 wherein the biasing means further includes a cushion means for controlling deceleration of the lid press plate near the first position.

20. An apparatus as recited in claim 14 wherein the biasing means further includes a cushion means for controlling deceleration of the lid press plate near the first position.

* * * * *